United States Patent [19]

Blase et al.

[11] Patent Number: 4,555,031

[45] Date of Patent: Nov. 26, 1985

[54] VEHICULAR CRANE OF HIGH CARRYING CAPACITY HAVING AN EXTENSIBLE ARM

[75] Inventors: Helmüt Blase, Sande; Peter Eiler, Oldenburg, both of Fed. Rep. of Germany

[73] Assignee: Fried. Krupp Gesellschaft mit beschränkter Haftung, Essen, Fed. Rep. of Germany

[21] Appl. No.: 541,115

[22] Filed: Oct. 12, 1983

[30] Foreign Application Priority Data

Oct. 12, 1982 [DE] Fed. Rep. of Germany ..... 3237706

[51] Int. Cl.[4] ..... B66C 23/78; B66C 23/04

[52] U.S. Cl. ..... 212/189; 212/231; 280/764.1; 280/765.1; 180/22; 180/140

[58] Field of Search ..... 212/189, 223, 227, 231–232, 212/237–238, 255, 261; 280/764.1, 765.1, 140; 180/22, 140

[56] References Cited

U.S. PATENT DOCUMENTS

| | | | |
|---|---|---|---|
| 1,612,393 | 12/1926 | Mossay | 180/22 |
| 2,957,592 | 10/1960 | Thacker | 212/189 |
| 3,184,076 | 5/1965 | Brown et al. | 212/189 |
| 3,570,619 | 3/1971 | Taylor | 180/22 |
| 3,638,805 | 2/1972 | Garnier | 212/189 |
| 3,680,720 | 8/1972 | Strange | 212/244 |
| 3,854,595 | 12/1974 | Kuhn | 212/189 |
| 3,972,745 | 2/1974 | Files | 180/140 |
| 4,394,913 | 7/1983 | Lanning et al. | 212/189 |

FOREIGN PATENT DOCUMENTS

| | | | |
|---|---|---|---|
| 1286274 | 1/1969 | Fed. Rep. of Germany | 212/189 |
| 2142750 | 4/1973 | Fed. Rep. of Germany | 212/189 |
| 2837399 | 3/1980 | Fed. Rep. of Germany | 212/189 |
| 773840 | 5/1957 | United Kingdom | 212/189 |
| 908413 | 10/1962 | United Kingdom | 212/254 |
| 956438 | 4/1964 | United Kingdom | 212/189 |

OTHER PUBLICATIONS

CTEC Transport Systems, All American "Steeler"—C-TEC Company, Bellevue, Washington, USA.

*Primary Examiner*—Galen L. Barefoot
*Assistant Examiner*—R. B. Johnson
*Attorney, Agent, or Firm*—Becker & Becker, Inc.

[57] ABSTRACT

Vehicular crane of high carrying capacity having an extensible arm, especially a telescopic arm. The vehicular crane has a maximum carrying capacity of greater than 250 metric tons obtained in such a way that, with a stroke length which is sufficient for the situation, the vehicular crane can be ready for use immediately after reaching the place of use without having to undergo expensive assembly procedures. The extensible arm of the crane is connected with an undercarriage via a frame part which carries pivot mounting. The crane is also provided with wheeled swivel supports as carrier supports which are provided with vertically adjustable ground support elements and undercarriage wheels of which the direction can be adjusted. On the drive side, the frame part is rigidly connected with the forward portion of the undercarriage, and on the other side is connected with two wheeled swivel supports, the undercarriage wheels of which respectively form a plurality of wheel sets, each of which has at least one pair of wheels. The undercarriage wheels, as well as the swivel connection of the wheel sets, are disposed below the wheeled swivel supports. The forward portion is provided with at least one vertically adjustable ground support element. The diameter of the undercarriage wheels of the wheeled swivel supports is less than the diameter of the undercarriage wheels of the forward portion.

4 Claims, 5 Drawing Figures

20
17'
17
T
T
1'
13
11
11
8
6
1
3
11
11'
15
13
13
8
7
1
20
7a
9a
5
10

VEHICULAR CRANE OF HIGH CARRYING CAPACITY HAVING AN EXTENSIBLE ARM

BACKGROUND OF THE INVENTION

The present invention relates to a vehicular crane of high carrying capacity; the extensible arm, especially a telescopic arm, of the crane is equipped with luffing cylinders and operating units, and is connected with an undercarriage by means of a frame part which carries the pivot mounting. The crane also is provided with carrier supports which can swivel relative to the frame part and which are provided with vertically adjustable ground support elements. The carrier supports are embodied as wheeled swivel supports which are provided with rotatable undercarriage wheels, with the wheels of a given wheeled swivel support being able to have their direction adjusted in common by means of a tie rod.

FIELD OF THE INVENTION

Vehicular cranes, having extensible arms in the form of lattice type or telescopic arms, for support in the operating position, are provided with a plurality of carrier supports. These carrier supports, generally four, are embodied as sliding supports, folding supports, or swivel supports, and vertically adjustable legs are provided thereon having pivotably connected base plates therewith.

Increasing the maximum carrying capacity of the crane to values over about 250 metric tons, as well as increasing the maximum moment of load, encounters problems in that the permissible overall weight of the vehicular crane is limited to values just below 100 metric tons by traffic regulations.

DESCRIPTION OF THE PRIOR ART

German Offenlegungsschrift No. 21 42 750 discloses a vehicular crane of the aforementioned general type, with each of the four wheeled swivel supports, which are embodied as supporting components of the undercarriage, being provided with a plurality of individual wheels. These wheels are arranged via swing beams next to the wheeled swivel supports on that side of the latter which is remote from the longitudinal central plane of the vehicular crane.

Drawbacks exist although the weight of the vehicular crane can be reduced somewhat by equipping the undercarriage with wheeled swivel supports which are movable relative to the frame part and which in the operating position in which they are swung away from the longitudinal central plane can at the same time also be used as carrier supports. This heretofore known crane has the drawback that the wheeled swivel supports are eccentrically stressed by means of the laterally disposed individual wheels, and must as a result have particularly large dimensions; furthermore, the use of this heretofore known vehicular crane is at least questionable, especially under load at the place of use.

A further drawback consists in that the individual wheels are either rotatable relative to the associated wheeled swivel support only within a narrow range, or, for achieving a sufficiently large turning capacity, act on the wheeled swivel supports by means of a disadvantageously large lever arm. It is in particular not possible to embody the individual wheels in such a way that they can move about an angle of rotation of 360°, which would give the vehicular crane a better maneuverability at the place of use.

Finally, the lateral arrangement of the individual wheels also results in the fact that the vehicular crane requires an unfavorably large amount of space.

British Pat. No. 767 420 describes a vehicular crane which is equipped with wheeled swivel supports, with the undercarriage wheels of the crane being disposed below the wheeled swivel supports therewith. However, each wheeled swivel support is provided with only one wheel set which comprises a pair of wheels and which is mounted on the free end section of the wheeled swivel support. Furthermore, each wheel set is embodied in such a way that the undercarriage wheels project laterally so as to be spaced beyond the wheeled swivel supports. The support and rotation device therefor is furthermore provided in such a way that it passes through and projects beyond the wheeled swivel supports in the vertical direction. As a result, although this heretofore known vehicular crane has a good maneuverability, as a result of the required penetration of the wheeled swivel supports, which serve as support components, it is not suitable for handling the previously discussed carrying capacity values above approximately 250 metric tons.

An object of the present invention is to provide a vehicular crane of high carrying capacity, particularly with a maximum carrying capacity of greater than 250 metric tons, which is sufficiently transportable yet can be made ready for operation in as short a time as possible without extensive assembly procedures at the place of use. In particular, the vehicular crane should be embodied in such a way that with a basic apparatus for a considerable number of applications, it can be ready practically immediately for use after reaching the site. Thus, expensive further transport units (as disclosed for example in German Offenlegungsschrift No. 28 33 535) at most are required for equipment for special cases in which, for example, particularly great lifting height is needed.

BRIEF DESCRIPTION OF THE DRAWINGS

These objects, and other objects and advantages of the present invention, will appear more clearly from the following specification in conjunction with the accompanying drawings, in which.

SUMMARY OF THE INVENTION

Figure 1:
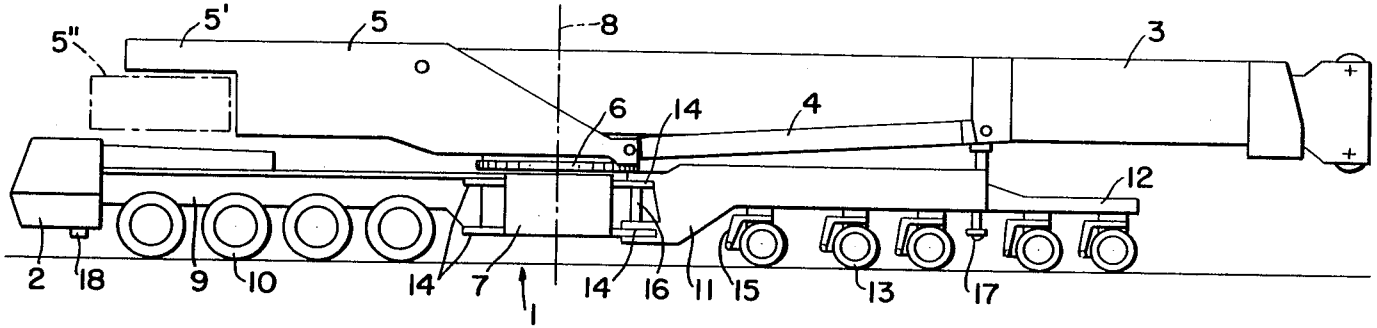
FIG. 1 is a schematic side view of one inventive embodiment of a vehicular crane, the undercarriage of which, on that side remote from the drive side, comprises two wheeled swivel supports and one rigid wheel support.

The vehicular crane of the present invention is characterized primarily in that the frame part, on the drive side, is connected rigidly with the front portion of the undercarriage, and on the other side, i.e. the rear portion, is connected with two wheeled swivel supports, each of the undercarriage wheels of which respectively form a plurality of wheel sets of at least one pair of wheels; the undercarriage wheels, as well as the swivel connection of the wheel sets, are disposed below the wheeled swivel supports. The vehicular crane is furthermore characterized in that the front portion, i.e. the pulling unit, is provided with at least one vertically adjustable ground support unit, and in that the diameter of the undercarriage wheels of the wheeled swivel supports is less than the diameter of the undercarriage wheels of the front portion.

Thus, the fundamental concept of the invention consists in connecting the frame part, which carries the pivot mounting, with two wheeled swivel supports only on that side which is remote from the drive side or forward portion of the undercarriage; furthermore, the wheeled swivel supports have undercarriage wheels which have smaller dimensions than dimensions of the wheels of the forward portion, and which respectively form a plurality of wheel sets each of which comprises at least one pair of wheels; all components of each of the wheel sets, i.e. also the swivel connection, are disposed below the wheeled swivel support therewith. Expediently, the forward portion, as is each wheeled swivel support, is provided with at least one vertically adjustable ground support element.

As a result of the use of undercarriage wheels in the forward and rear portions of the undercarriage having different sizes, as well as due to the arrangement and mounting of a plurality of wheel sets exclusively below each of the wheeled swivel supports, not only the reliability is improved during transport on the roads and during operation under load at the place of use. The inventive crane furthermore has the advantage that the path of lines of force within the wheeled swivel supports is not disturbed during symmetrical introduction of force into these swivel supports by components or openings, so that the wheeled swivel supports, with a view toward saving weight, can be dimensioned, with the use of a plurality of small-volumed undercarriage wheels permitting the required low overall height of the vehicular crane. Disposing the undercarriage wheels below the wheeled swivel supports furthermore leads to a reduction of the width of the vehicular crane and to a reduction of the space which is required; this place requirement or space occupied can otherwise have a negative or disturbing effect, especially at the place of use.

Finally, equipping the rigidly connected front portion with at least one ground support element results in a vehicular crane which can be operated readily as a unit having three-point support, with the support basis under load being variable in a wide range by swinging the wheeled swivel supports out from the longitudinal axis of the undercarriage.

The savings in weight which can be achieved with the aforementioned arrangement, under certain circumstances, is so great that a vehicular crane having a maximum crane carrying capacity of at least 500 metric tons and a telescoping length of about 35 m can be transported as a working unit which is practically ready for operation notwithstanding the existing regulations.

The steering and control mechanism of the undercarriage wheels of each of the wheeled swivel supports should be provided in such a way that the vehicular crane, if necessary, can be transported in a position where the longitudinal axis of the undercarriage is at an angle to the direction of travel, and in particular especially even when the wheeled swivel supports are not folded-in in the driving position toward the longitudinal axis. If necessary, the wheel sets of the wheeled swivel supports can also be embodied as multiple wheel sets which are rotatable relative to the wheeled swivel supports.

Pursuant to a further specific embodiment of the present invention, the undercarriage, on that side opposite the drive side, can be provided with a wheel support which is rigid relative to the longitudinal axis of the undercarriage. In conformity with the wheeled swivel supports, this wheel support can be provided with undercarriage wheels, or with four undercarriage wheels which are arranged next to one another and are combined in pairs. This specific embodiment is preferably embodied in such a way that, in the driving position, the wheel support is connected immovably with the arrested wheeled swivel supports and forms an elongation thereof in the direction of the longitudinal axis of the undercarriage. Furthermore, when the wheeled swivel supports are spread apart, the wheel support can be connected directly to the frame part, resulting in an increase of the weight which can be transported by the undercarriage.

Pursuant to yet a further advantageous specific embodiment of the present invention, the frame part, on that side opposite the wheeled swivel supports, can be provided with connections to which swivel supports can be mounted, which are effective only in the operating position. After the place of use has been reached, if necessary these additional swivel supports can be mounted on the frame part, so that the undercarriage therewith, which is embodied to be self-propelled and/or is provided with a pulling unit, is provided with an additional support. The additional swivel supports can be provided embodied as standard swivel supports, i.e. can be merely with vertically adjustable ground support elements, or can be embodied in conformity with the aforementioned wheeled swivel supports.

Pursuant to yet another proposal of the present invention, the front portion, namely the pulling unit, can be detachably connected with the frame part.

The concept of the present invention can furthermore be used with all devices which have an extensible arm or similar devices, such as concrete pumping devices having swiveling, raisable supporting arms for the concrete hose.

DESCRIPTION OF PREFERRED EMBODIMENTS

Referring now to the drawings in detail, the essential components of the vehicular crane illustrated in FIG. 1 are a self-propelled, nine-axle undercarriage 1 with a driver cab 2, a multiple extensible telescopic arm 3 having tilting or luffing cylinders 4 linked or articulated to the sides thereof and a crane operating station 5 to which the telescopic arm 3 and the luffing cylinders 4 are connected via horizontal shafts. By means of a slewing track ring 6, the crane operating station 5 is rotatably connected with a frame part 7 which is provided as a central frame of the undercarriage 1.

The crane operating station 5 is equipped with a bracket 5' on which counterweights 5'' can be mounted to adapt to working conditions encountered at any given time; the counterweights 5'' are indicated in dot-dash lines in FIG. 1.

Due to the illustrated arrangement of the telescopic arm 3, and the crane operating station 5 with the bracket 5' and the counterweights 5'' included therewith, in the vicinity of the rear portion of the undercarriage 1, there results in this region a center of gravity shift which makes possible a favorable load distribution and a driving operation which is protective as to the roads, when particularly transportable wheel sets are provided.

The undercarriage 1 comprises the frame part 7 with the slewing track ring 6, a four-axle front portion or pulling unit 9 which is rigidly connected with the frame part 7 and has large volume undercarriage wheels 10, two wheeled swivel supports 11 which are connected pivotably to the opposite side of the frame part 7, and a wheel support 11 which is disposed on the same side and which is immovable relative to the longitudinal axis 1' (FIG. 2) of the undercarriage, yet made detachable therefrom.

The two wheeled swivel supports 11, and the rigid wheel support 12, which extends the former in the direction of the longitudinal axis 1' of the undercarriage, form the rear part of the undercarriage 1, in contrast to the pulling unit or front portion 9. These parts, as shown in the drawing, are provided respectively with undercarriage wheels 13 of which the diameter is less than the diameter of the undercarriage wheels 10 of the pulling unit or front portion 9. In the preferred illustrated embodiment, the wheeled swivel supports 11, in cooperation with the rigid wheel support 12, constitute the five-axle rear portion of the undercarriage 1.

In the illustrated driving position (FIG. 1), the wheel support 12 is mounted fixed to the end sections of the two wheeled swivel supports 11, which in turn are fixed on the frame part 7 by means of suitable fixing devices. In order to be able to support the frame part 7 additionally or possibly also independently of the pulling unit 9, both ends of the frame part 7, on that side opposite the wheeled swivel supports 11, are provided with connections 14 to which additional swivel supports can be fastened after the place of use is reached. These additional swivel supports can be embodied in any desired manner, for example as simple swivel supports without undercarriage wheels 13, or as wheeled swivel supports.

Each of the wheeled swivel supports 11, which are independent of one another, are provided with three independent wheel sets 15, each of which has two undercarriage wheels 13 which can be mounted below the pertaining wheeled swivel support 11 and can be adjustable with regard to the orientation thereof. The connection with the frame part 7 is effected via swivel shafts 16 which at the same time are held by lateral connections 14 located on that side remote from the drive side.

Figures 1A, 3, 4:
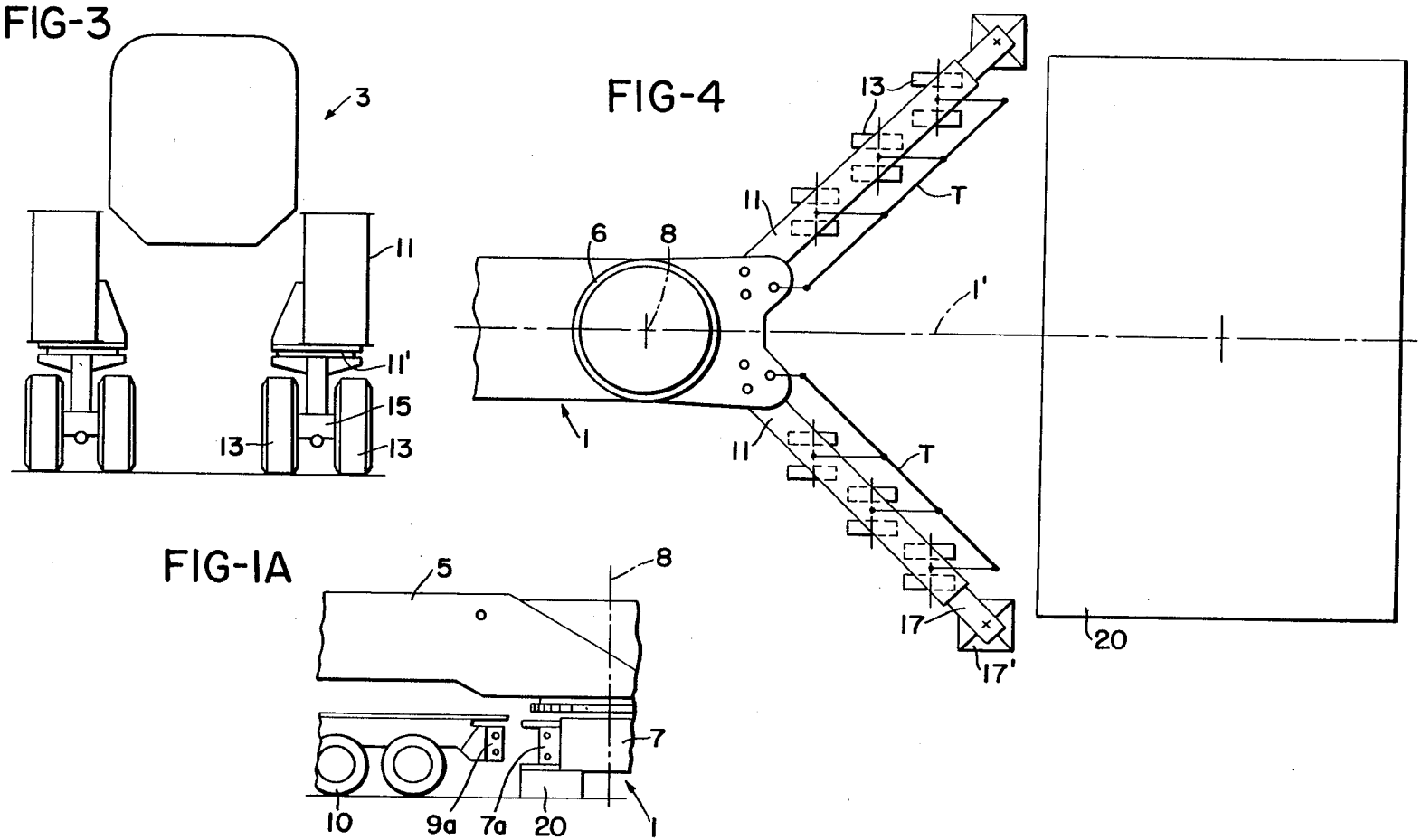
FIG. 1A schematically shows a detachable front end portion of a vehicular crane undercarriage in a view similar to that of FIG. 1.
FIG. 3 is a schematic section, in a different scale, through an inventive embodiment of a vehicular crane having wheeled swivel supports, the wheel sets of which, including their swivel connection, are disposed entirely below the wheeled swivel support therewith.
FIG. 4 is a plan view of the rear portion of an inventive embodiment of the undercarriage of a vehicular crane showing the wheeled swivel supports in the operating position and showing a load which is to be moved away by the vehicular crane.

As shown in FIG. 3, the independent wheel sets 15 of the wheeled swivel supports 11 are connected to the underside of the latter by means of a swivel connection 11'. Thus, not only are the undercarriage wheels 13, which are disposed in pairs, located below the wheeled swivel supports 11, but the swivel connections 11' also are disposed therebelow. The associated telescopic arm 3 essentially is disposed above the wheeled swivel supports 11.

Figure 2:
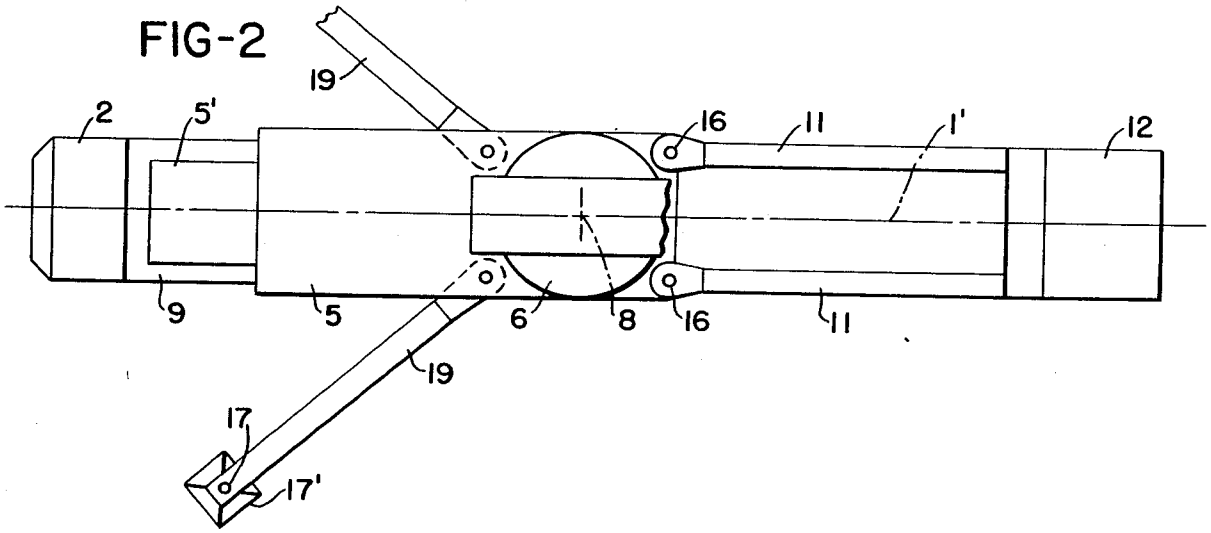
FIG. 2 is a plan view of the schematic vehicular crane construction illustrated in FIG. 1, with later added swivel supports in the spread-apart operating position (the telescopic arm behind the region of the pivot mounting which carries such arm, is not shown in order to facilitate illustration)

Each of the wheeled swivel supports 11 is provided with a vertically-adjustable ground support element 17 which in turn can be placed upon the ground by means of base plates 17' (illustrated in FIGS. 2 and 4). The pulling unit 9, as shown in FIGS. 1 and 2, forms the front portion of the undercarriage 1 and is correspondingly constructed, i.e. it is provided with its own support unit that comprises a support element 18 which is vertically adjustable and can be placed upon the ground. After the place of use has been reached, this support element additionally can be used to support the undercarriage 1, and in particularly either with the wheeled swivel supports 11 swung out in the working position, or together with these swivel supports and swivel supports which later can be mounted on the drive side. Even without these extra swivel supports, i.e. without special expense at the place of use, a three-point support of the undercarriage 1 can be realized. Equipping the pulling unit 9, which forms the front portion detachable via connection bracket or pad **9*a* and connection web or flange 7*a* supportable on a bearing block 20 according to FIG. 1A, with the support element 18** thus has the advantage that the vehicular crane, possible even without additionally added swivel supports, can move and lift heavy loads.

The aforementioned possibly later to be installed swivel supports 19 are illustrated in the spread apart working position in the illustration of FIG. 2. They differ from the wheeled swivel supports 11 only in that they are equipped merely with a ground support element 17 along with a base plate 17'.

The two wheeled swivel supports 11, elongated to form the rigid wheel support 12 having two wheel sets 15, are still illustrated in the driving position in which they are folded-in toward the longitudinal axis 1' of the undercarriage, and in which they are fixedly connected with the wheel support 12 and the frame part 7.

The additional two wheeled swivel supports, of course, can be provided with undercarriage wheels in conformity with the wheeled swivel supports 11. This has the additional advantage that the vehicular crane can be moved when the swivel supports are spread apart.

By attaching the additional two wheeled swivel supports 19 to those connections 14 of the frame part located on the drive side thereof, it is additionally possible to realize a five-point support of the undercarriage at the place of use.

The advantage associated with the inclusion of the additional swivel supports 19 also can be seen in that the undercarriage 1, if necessary, also can be usable without the aforementioned detachable pulling unit or front portion 9 shown in FIGS. 1 and 2. The two swivel supports 19 furthermore form structural elements which can be mounted and removed at the place of use without any particular difficulty.

In the operating position shown in FIG. 4, the telescopic arm 3 (shown in FIG. 1) supports a heavy load 20 in the form of a tank. The stability of the undercarriage 1 of the vehicular crane is increased by the fact that the wheeled swivel supports 11 which face the load 20 are secured in a spread position. The respective wheel sets belonging thereto, along with the undercarriage wheels 13, are disposed by means of a tie rod T in a linked connection therewith which is schematically shown in FIG. 4 and which is common to them in the direction of travel, i.e. parallel to the longitudinal axis 1' of the undercarriage 1.

The wheeled swivel supports 11 are furthermore embodied in such a way that the vertically adjustable ground support elements 17, which are provided with the pivotably connected base plate 17', can be telescoped. By extending the vertically adjustable ground support elements 17 relative to the wheeled swivel supports 11, the support base of the undercarriage 1 can be varied infinitely within a certain range and can be adapted to the conditions of the place where it is being used.

In contrast to the previously described embodiments, the undercarriage 1 presently being discussed is provided on that side remote from the drive side with only two wheeled swivel supports 11; in other words, no rigid wheel support 12 is provided.

Underlying all of the illustrated and described embodiments is the overriding inventive concept of embodying the wheeled swivel supports, which are simultaneously utilized as carrier supports and transport components of the undercarriage, in such a way, with sufficient maneuverability, that a not inconsiderable savings in weight can be achieved. This makes possible, without exceeding the acceptable threshold for the overall weight, the transport of a vehicular crane having an extensible arm which essentially is ready for immediate use, with a sufficient stroke length and a maximum crane carrying capacity of greater than 250 metric tons.

The undercarriage 1 preferably is embodied in such a way that the maximum rear vehicle strength, i.e. the distance between the axis of rotation 8 and the rear edge of the vehicle, does not exceed a value in a range of from 6.5 to 7 m when the wheeled swivel supports 11 are in the spread-apart operating position, whereby the large free working surface is available.

In other respects, the undercarriage, as well as the possibly additionally present pulling unit, can be embodied in any desired manner, i.e. can have undercarriage wheels with rigid axles, pivotable axles, or steering and driving axles.

The present invention is, of course, in no way restricted to the specific disclosure of the specification and drawings, but also encompasses any modifications within the scope of the appended claims.

What we claim is:

1. A vehicular crane of high carrying capacity, said crane having an extensible arm which is equipped with luffing cylinders and drive units, and is connected with a first undercarriage via a frame part which carries a pivot mounting for said arm, with said undercarriage having a longitudinal axis as well as a front portion and a rear portion, and said frame part having a first drive side and a second side; said crane in combination further comprising:

two carrier supports, in the form of wheeled swivel supports, which are connected to said second side of said frame part in such a way that they can swivel relative thereto; with said drive side of said frame part being rigidly connected with said front portion of said undercarriage;

vertically adjustable first ground support elements connected with said wheeled swivel supports;

swiveling first undercarriage wheels connected with said wheeled swivel supports, said first undercarriage wheels forming a plurality of wheel sets, each of which comprises at least one pair of wheels; the wheels of a given wheeled swivel support having direction thereof adjustable in common as to direction of travel parallel to the longitudinal axis of the undercarriage;

respective swivel connections, one for effecting the mounting of each wheel set with its wheeled swivel support; said first undercarriage wheels and said swivel connections being disposed below their wheeled swivel support;

at least one vertically adjustable second ground support element provided on said front portion of said undercarriage;

second undercarriage wheels connected with said front portion of said undercarriage, with the diameter of said first undercarriage wheels of said wheeled swivel supports being less than the diameter of said second undercarriage wheels of said front portion of said undercarriage, all of said wheels being effective simultaneously and together with the extensible arm having a sufficient stroke length and a maximum crane carrying capacity of greater than 250 metric tons for which at least three-point support of the undercarriage can be realized; and a wheel support detachably connected with said rear portion of said undercarriage, and which is located accordingly relative to the longitudinal axis of said undercarriage; said drive side of said frame part being provided with connections to which can be attached additional swivel supports in the operating position of said crane.

2. A vehicular crane in combination according to claim 1, in which said front portion of said undercarriage is a pulling unit detachably connected with said drive side of said frame part.

3. A vehicular crane in combination according to claim 1, including two additional swivel supports with said undercarriage wheels to form a five-point support of the undercarriage at the place of use.

4. A vehicular crane in combination according to claim 1, in which said undercarriage is constructed in such a way that maximum rear vehicle length, i.e. distance between axis of rotation and a rear edge of the vehicle is in a range of from 6.5 to 7 m when said wheeled swivel supports are in the spread-apart operating position, whereby a large free working surface is available.

* * * * *